US009396917B2

(12) United States Patent
Rauschenbach et al.

(10) Patent No.: US 9,396,917 B2
(45) Date of Patent: Jul. 19, 2016

(54) DEVICE FOR TRANSFERRING IONS FROM HIGH TO LOW PRESSURE ATMOSPHERE, SYSTEM AND USE

(71) Applicants: Max-Planck-Gesellschaft Zur Foerderung Der Wissenschaften E.V., Munich (DE); Technische Universitaet Berlin, Berlin (DE)

(72) Inventors: Stephan Rauschenbach, Stuttgart (DE); Matthias Pauly, Stuttgart (DE); Gordon Rinke, Stuttgart (DE); Ralf Vogelgesang, Stuttgart (DE); Klaus Kern, Stuttgart (DE); Julius Reiss, Berlin (DE); Joern Sesterhenn, Berlin (DE); Mario Sroka, Berlin (DE)

(73) Assignees: Max-Planck-Gesellschaft Zur Foerderung Der Wissenschaften E.V., Munich (DE); TechNische Universitaet Berlin, Berlin (DE)

( * ) Notice: Subject to any disclaimer, the term of this patent is extended or adjusted under 35 U.S.C. 154(b) by 21 days.

(21) Appl. No.: 14/380,012

(22) PCT Filed: Feb. 21, 2013

(86) PCT No.: PCT/EP2013/053471
§ 371 (c)(1),
(2) Date: Aug. 20, 2014

(87) PCT Pub. No.: WO2013/124364
PCT Pub. Date: Aug. 29, 2013

(65) Prior Publication Data

US 2016/0020078 A1 Jan. 21, 2016

Related U.S. Application Data

(60) Provisional application No. 61/647,940, filed on May 16, 2012.

(30) Foreign Application Priority Data

Feb. 21, 2012 (EP) ..... 12156326

(51) Int. Cl.
*H01J 49/04* (2006.01)

(52) U.S. Cl.
CPC ..... *H01J 49/0404* (2013.01); *H01J 49/0445* (2013.01); *H01J 49/0459* (2013.01)

(58) Field of Classification Search
CPC . H01J 49/0404; H01J 49/0445; H01J 49/045; H01J 49/062
USPC ..... 250/288, 424, 281, 282, 396 R; 73/61.56
See application file for complete search history.

(56) References Cited

U.S. PATENT DOCUMENTS

2003/0160166 A1 8/2003 Glish et al.
2005/0230635 A1* 10/2005 Takats ..... H01J 49/142 250/424

(Continued)

OTHER PUBLICATIONS

Search Report and Written Opinion, dated Mar. 19, 2013, corresponding to International Application No. PCT/EP2013/053471 (filed Feb. 21, 2013), parent of the present application, 13 pp.

(Continued)

*Primary Examiner* — David A Vanore
(74) *Attorney, Agent, or Firm* — Lathrop & Gage LLP

(57) ABSTRACT

Tube-like device (100) for transferring ions generated by means of ion generation source (4) comprising a cylindrical middle portion (104) and an inlet portion (102) for introduction of the ions in at least one ion cloud into the cylindrical middle portion (104), wherein a flow direction of the ions is along a longitudinal axis (L) of the tube-like device (100), wherein the inlet portion (102) is formed tapering funnel-like towards the cylindrical middle portion (104).

20 Claims, 5 Drawing Sheets

(56) References Cited

U.S. PATENT DOCUMENTS

2006/0108539 A1* 5/2006 Franzen ..... G01N 27/68 250/423 P
2009/0212210 A1* 8/2009 Finlay ..... H01J 49/0404 250/288
2009/0321655 A1* 12/2009 Makarov ..... H01J 49/065 250/396 R
2010/0038532 A1* 2/2010 Makarov ..... H01J 49/062 250/288
2010/0078553 A1 4/2010 Corso et al.
2010/0163719 A1* 7/2010 Loucks, Jr. ..... G01N 30/7246 250/281
2011/0068263 A1* 3/2011 Wouters ..... H01J 49/0445 250/282
2012/0228492 A1* 9/2012 Franzen ..... H01J 49/401 250/288
2014/0061500 A1* 3/2014 Yang ..... H01J 49/044 250/424

OTHER PUBLICATIONS

Takats et al. (2005) "Ambient Mass Spectrometry Using Desorption Electrospray Ionization (DESI): Instrumentation, Mechanisms and Applications in Forensics, Chemistry, and Biology," J Mass Spectrom 40:1261-1275.

* cited by examiner

DEVICE FOR TRANSFERRING IONS FROM HIGH TO LOW PRESSURE ATMOSPHERE, SYSTEM AND USE

CROSS-REFERENCE TO RELATED APPLICATIONS

This application is a U.S. National Stage Application filed under 35 U.S.C. §371 of International Application No. PCT/EP2013/053471, filed Feb. 21, 2013, which claims the benefit of European Application No. 12 156 326.6, filed Feb. 21, 2012, and U.S. Provisional Patent Application No. 61/647,940, filed May 16, 2012. All of these applications are hereby incorporated by reference in their entireties.

BACKGROUND OF THE INVENTION

The present invention concerns a tube-like device for transferring ions generated by means of an ion generation source, comprising a cylindrical middle portion and an inlet portion to introduce ions in at least one ion cloud into the cylindrical middle portion, wherein at least one flow direction of the ions is along a longitudinal axis of the tube-like device.

In analytical chemistry, to determine the composition of unknown analytes, frequently mass spectrometry is used. The specimen composition to be tested is transformed by an ion generation source at atmospheric pressure from liquid or solid state to gaseous phase and ionised or fragmented, respectively. The resulting ions undergo acceleration in an electrical field, are transferred to a vacuum atmosphere through a known capillary and further analyzed by mass-spectroscopy according to the mass-to-charge ratio (m/z ratio).

The capillary has an orifice arranged centrally in the longitudinal direction through which the gaseous phase containing ions or ion fragments flows in the direction of the analyser. In the known manner such orifices in the longitudinal direction of the capillary have a constant diameter of less than 1 mm.

The embodiments known from the prior art are disadvantageous because the gaseous ion cloud emerging from the ion generation source expands due to space charge effects. Thus, only a small percentage of around 1-10% of generated ions are transferred through the central channel of the capillary towards the analyser [1]. The remaining 90-99% of the generated ions hit the outer surface of the capillary and are therefore not analysed, detected or transmitted.

Furthermore the geometric form of the capillaries known from the prior art causes perturbations in the gas flow at the capillary entrance, especially at the edges like for example stall or vortex flow, inducing further ion losses and reducing the ion yield at the analyser.

Due to the low yield long time periods are needed in order to achieve sufficient material quantities for further analysis.

The object of the present invention is therefore to provide a tube-like device for transferring an increased amount of ions generated by an ion generation source and to reduce ion losses. Moreover, the object of the present invention is to realize a detection of almost all contents of a desired sample. Moreover, the object of the present invention is to provide fast screening measurements.

This object is achieved by the device according the features of claim 1. Advantageous embodiments and refinements are the subject of the subclaims.

BRIEF SUMMARY OF THE INVENTION

In the present description, ions preferably mean ionised atoms, ionised molecules or ionised molecule fragments.

Instead of molecular ions, it is also possible to transfer particles, like neutral molecules, molecular fragments, neutral atoms, neutral inorganic nanoparticles as for instance carbon nanotubes, biological or artificial macromolecules as proteins, polymers, dendrimers, organic nanoparticles as viruses by a tube-like device according the invention from a high pressure atmosphere to a low pressure atmosphere.

The device according to the invention is tube-like in structure and has at least one continuous orifice extending in the longitudinal direction along the longitudinal axis of the device wherein the orifice is preferably channel-like. The term longitudinal direction here means the direction in which the device according to the invention has its greatest physical extent. As longitudinal axis the axis along the longitudinal direction is to be understood by which the middle portion of the device according to the invention is preferably rotationally symmetric.

In order to generate ions, any known ionisation method can be used such as chemical ionisation or photo ionisation. According the invention, preferably atmospheric pressure ionisation (API) sources like electrospray ionisation (ESI), atmospheric pressure physical ionisation (APPI), atmospheric pressure chemical ionisation (APCI) are used for generating ions, especially nanospray sources or orthogonal pneumatic sources are used according to the invention.

The tube-like device according to the invention comprises an inlet portion within which and/or in front of which the ion gas cloud is initially emitted by the ion generation source and a cylindrical middle portion through which the ions in at least one ion cloud are transferred from high pressure atmosphere to low pressure atmosphere. Preferably, the ions are released within the inlet portion and/or the cylindrical middle portion.

By "tube-like" it is to be understood that the device according to the invention comprises a hollow body with at least one continuous orifice in longitudinal direction.

The term "ion generation source" is preferably to be understood as a device or part of a device at a certain position or region, preferably within the inlet portion, capable of releasing ions from this position or region. This position or region has not to be identical to the position or region where the actual ionization process occurs.

The ion cloud emerging from the ion generation source comprise an expanding charged gas cloud. This gaseous ion cloud can for example comprise a finely atomised aerosol which is composed of ionized droplets and carrier molecules within neutral background gas, or merely of ions without carrier molecules in the background gas.

The core of the present invention is that the inlet portion is formed such that the ion cloud that is emitted from the source is transported swiftly into the cylindrical middle portion, before space charge expansion forces make the ions collide with the wall resulting in ion losses. The outlet region is, in the simplest case, the end portion of the cylindrical middle portion in longitudinal direction which is shaped to guide the expansion of the emitted gas cloud from the end portion into the low pressure region, for example vacuum, such that a collimated particle beam is the result.

Advantageously the ion generation source is arranged in longitudinal direction directly adjacent (remoted) to the funnel-like inlet portion, particularly preferably within the funnel-like inlet portion. This is preferred because ions released within the funnel-like inlet portion have less space charge expansion and thus a better transmission through the device according to the invention.

The specimen material to be characterised, for example in liquid or solid form, is transformed into gaseous form and at the same time ionised by the ion generation source at atmospheric pressure or above atmospheric pressure or below atmospheric pressure. On emergence of the resulting generated ions from the ion generation source, a charge surplus of similar ions is caused so that ionised specimen material emerges from the ion generation source as a finely atomised aerosol in the form of a Taylor cone. The aerosol cloud is here initially composed of the generated ions and corresponding carrier material within a background gas. Preferred carrier materials are volatile fluids such as for example water, alcohols, ketones, nitriles, cycloalkanes or also chlorine compounds. By application of temperature or vacuum, the carrier material is extracted so that only the generated ions remain in the ion gas cloud.

According to the invention, electrospray ionisation sources are used to generate ions, but evidently the invention is not restricted to this. Depending on design of ion generation sources, these can be arranged remotely in the longitudinal direction in front of the funnel-like inlet portion of the present device, as known from orthogonal pneumatic ion sources.

If, for example, a nanospray ionisation source is used to generate ions, it is arranged inside the funnel-like inlet portion in the longitudinal direction. This is advantageous as thus the ion gas cloud emerging from the nanospray ion generation source expands due to space charge, whereby according to the invention this expansion is limited by the funnel-like or concavely and/or convexly curved inner wall of the inlet portion and bundled in a pre-determinable fashion, so that between 80 and 100% of all ions generated can be transferred from the inlet portion through the subsequent cylindrical middle portion to the end portion.

A funnel-shaped tapering towards the cylindrical middle portion is an advantageous shape in order to prevent space charge expansion forces resulting in ion loss ratios. In addition, the funnel shape increases the special region in which ions are accepted for transmission. Depending on design of the inlet portion, therefore three-dimensional forms of the ion gas cloud and also the ion flight paths can be pre-determined and controlled.

Because of the funnel-like tapering inlet portion, the gaseous ion cloud enters in a controlled and pre-determinable manner the cylindrical middle portion which has a continuous channel for ion guidance and ion transfer extending in the longitudinal direction. Such a focussing or bundling of the ion cloud reduces perturbation inside the cylindrical middle portion so that according to the invention, the ion loss ratio within the device according to the invention is substantially reduced. By entering into the cylindrical section, the ions will be exposed to turbulence, for example, in particular for the case of the ion transfer in the presence of air from 1 bar to 20 mbar with a tube-like device according to the invention providing an inner diameter of 1 mm. The turbulence starts when the acceleration of the gas is done, e.g. when the minimum diameter is reached which corresponds here with the inner diameter of the cylindrical middle portion. Surprisingly, the caused turbulence does not direct or transport the ions within the cylindrical middle portion to the inner walls causing ion loss ratios. These losses are caused indeed by space charge effects resulting from coulomb repulsion due to ions with the same charge and/or by different time scales of turbulence and ion acceleration.

Up to the sources space charge limit, advantageously according to the invention up to 80%, preferably up to 90% and most preferably up to 100% of the ions emitted by the ion generation source are transmitted into low pressure atmosphere, like vacuum by the present device. The ion loss ratio according to the invention is therefore at least less than 20%, preferably less than 1% and usually preferably 0%. The ion transmission ratio here is preferably the ratio of the intensity of the ions transmitted into low pressure atmosphere to the intensity of the total emitted ions by the ion generation source. Thus the ion loss ratio corresponds to the subtraction of the ion transmission ratio from 1, whereby the minuend is correspondingly 1 and the subtrahend corresponding to the ion transmission ratio. The space charge limit of the source according to the invention, defined by the maximum current transmitted at 100% transmittance, is 50 nA, preferably up to 100 nA and most preferably up to 200 nA. Beyond that limit the maximum current is transmitted, while the loss current increases with increasing inflowing current.

The device according to the invention realizes a high ion transfer rate, preferable from high pressure to low pressure atmosphere, by least possible gas loading.

According to the invention the funnel-like inlet portion has an angle of 0 to 90°, preferably in the range from 0 to 42°, wherein the inlet portion opening angle is spanned between the longitudinal axis and a straight inner wall segment of the inlet portion extending in the longitudinal direction. If the inner wall segment is formed curved concavely and/or convexly, the angle is established by the longitudinal axis and a straight line tangent extending in the longitudinal direction. The curvature is preferably formed as a smooth inner surface of the funnel region avoiding kinks that moreover transforms smoothly into the cylindrical part of the middle portion. The kinks, defined by jumps in the opening angle value along the funnel's longitudinal direction, are below 10° and preferably below 5° and most preferably about 0°.

Preferably, the funnel-like inlet portion converges like a trumpet.

Moreover, preferably, the inlet portion comprises an opening within which the ion generation source is arranged. The opening has an inner diameter in the range of 2 mm to 25 mm, preferably 3 mm to 13 mm and most preferred 6 mm to 10 mm.

Preferably, the ion generation source is arranged within a funnel-like inlet portion being part of the tube-like device. In order to release ions within the funnel-like inlet portion and/or within the cylindrical middle portion, the ion generation source is preferably arranged centrally within the opening of the funnel-like inlet portion.

In addition, the radial distance between the ion generation source and the inner wall region of the funnel-like inlet portion has preferably a range of 0.01 mm to 25 mm, more preferred 0.5 mm to 8 mm. In order to achieve highest possible ion yields, the ion generation source may be more preferably arranged within the funnel-like inlet portion in such a way that a radial source-to-wall distance of 1 mm±0.5 mm results, wherein the ion generation source is preferably arranged centrally along the longitudinal axis of the device.

The reduction in cross-section area from the funnel-like inlet portion towards the cylindrical middle portion, wherein the cross-section in the simplest case is arranged perpendicular to the longitudinal axis of the device according to the invention, causes an acceleration of the ions through the cylindrical middle portion.

Moreover, the inlet portion causes a reduction of turbulences due to its smooth funnel-like shape according to the invention which could also be shaped in a concave and/or convex manner.

According to the present invention, the term "cylindrical middle portion" is not limited to the shape of a right circular cylinder of the middle portion but is also to be understood in general as hollow shape with a surface area, a floor area and a top area, wherein these areas may curved, continuous, non-continuous or arranged at least partially parallel to each other but are not obliged to, like for example cylindroids, hyperbolic cylinders, parabolic cylinders, prisms, bevel cylinders or the like.

In a further advantageous embodiment the tube-like device further comprises an outlet portion after the cylindrical middle portion for removing the ions, wherein the outlet portion is formed expanding funnel-like from the cylindrical middle portion.

Furthermore according to the invention it is advantageous for the outlet portion to be shaped in an expanding manner like a funnel. Whereas the inlet portion of the device according to the invention is under atmospheric pressure or close to atmospheric pressure, the outlet portion in contrast is under a reduced pressure. According to the invention, the tube-like device connects two regions where the pressure changes, e.g. is reduced, in the range of 0.5 to 5 orders in magnitude. Preferably the inlet portion is in an atmosphere with 1 bar pressure whereas the outlet portion is located in an atmosphere with a pressure in the range of 1 to 200 mbar. By using nanospray ionisation source it also conceivable that the inlet portion is located in an atmosphere of 50 to 300 mbar whereas the outlet portion is located in an atmosphere with a pressure in the range of 0.5 to 10 mbar. According the invention, the pressure of the atmosphere in which the inlet portion is arranged is chosen to be high enough to support electrospray ionisation and desolvation. Thus, the above mentioned pressure values are relevant for the use of the present device and have to be realized by exact scalable and sensitive vacuum pumps. As known from the prior art, ions enter this reduced pressure or vacuum atmosphere, on passage into the outlet portion or on emergence from the outlet portion, swirls, shockwaves or similar turbulences are induced partly by interaction with further parts of the capillary, causing a clear change in the ion flight path. In addition, the vacuum atmosphere causes an expansion of the ion gas flowing into the outlet portion, causing additional turbulence. According to the invention it is therefore advantageous to form the outlet portion as a funnel expanding conically away from the cylindrical middle portion. This funnel-shaped design of the outlet portion limits the ions contained in the ion gas. The expansion caused by the vacuum is physically limited by the funnel-like design of the outlet portion. Moreover, in dependence of the working point, additional advantageous shapes of the outlet portion may be constructed in order to focus the ion gas cloud.

According to the invention the funnel-like outlet portion by its geometry deflects the ion flight paths again in a substantially parallel orientation to each other such that as many ions as possible can be transmitted without loss to the analyser or next ion optics element which according to the present device is also arranged in the vacuum.

According to the invention the funnel-like outlet portion has an opening angle in the range of 5 to 90°, preferably in the range of 20 to 600 wherein the outlet portion opening angle is spanned between the longitudinal axis and a straight inner wall segment of the outlet portion extending in the longitudinal direction. If the inner wall segment of the outlet portion is curved concavely and/or convexly, the angle is established by the longitudinal axis and a straight line tangent extending in the longitudinal direction.

Thus, the specific three-dimensional shape of the device according the invention determines the ion gas flow into and through the device according to the invention. By using the funnel-like inlet and outlet portion, the ion throughput is improved significantly. Moreover, being concavely shaped, both inlet and outlet portion maximise the ion throughput additionally through the device according to the invention.

In a further advantageous embodiment the funnel-like outlet segment has an outlet area which is limited in the longitudinal direction by side closing edge points of the outlet portion. This is advantageous as thus the form of the outlet area guides the spread of the emerging ion flight paths and determines the flight speed of the ions. In the simplest case the side closing edge points span a flat plane which is arranged perpendicular to the longitudinal axis and has a common intersection point with this. Advantageously the outlet area has a round form but evidently is not restricted to this. Thus it is also conceivable to provide a form of outlet area different from round, for example elliptical, angular or polygonal. Advantageously the form of the outlet area is selected such that the ion clouds are limited in their space charge expansion.

Furthermore it is conceivable that a plane spanned by the side closing edge points is formed sloping and for example assumes an angle in relation to the longitudinal axis different from 90°, preferably tilted with respect to the longitudinal axis in the range of 1 to 50°.

Furthermore it is conceivable that the edge region of the outlet portion is formed with different lengths in the longitudinal direction, for example as a zig-zag or undulating in order to deflect the emitting ions in direction of the desired substrate, for example a mass analyzer or an ion separator or other downstream ion optical element.

In a further advantageous embodiment a first inner wall region of the outlet portion is at least partially curved concavely in the longitudinal direction between the cylindrical middle portion and the outlet area and formed preferably rotationally symmetrical in relation to the longitudinal axis. This is advantageous as due to the concave curvature of the first inner wall region, the ions are guided from the cylindrical middle portion into the outlet portion. Preferably, the concave shape of the inner wall region changes to a convex curvature along the longitudinal axis towards the outlet area. Preferably, the outlet portion expands bell-shaped. Moreover, also convex curvatures may be realized.

Furthermore the volume region which is spanned by the first inner wall region and which is formed preferably rotationally symmetrically in relation to the longitudinal axis causes an acceleration of the ions. However, it is conceivable that the first inner wall region has at least two wall areas shaping in a different way from each other, having for example different slopes with respect to the longitudinal axis.

In a further advantageous embodiment a second inner wall region of the outlet portion, which follows the first inner wall and which is limited by the outlet area, is formed cylindrical in the longitudinal direction. This is advantageous as the ions emerging from the first inner wall region undergo an acceleration and are deflected by the cylindrically formed second inner wall region such that the ion flight paths are arranged substantially mutually parallel to each other and to the inner walls of the second inner wall region. This is advantageous as the ions are detected by the analyser or hit the substrate to be coated while bundled in this way.

In a further preferred embodiment, opposing inner walls of the second inner wall region are arranged parallel to each other with respect to the longitudinal axis. This is advantageous as thus the ion flight paths undergo a substantially parallel orientation which causes bundling of the ions and avoids swirls and turbulence within the outlet portion. According to the invention therefore the ion yield i.e. the ion transmittance which emerges at the outlet portion from the device according to the invention is clearly increased in comparison with known devices from the prior art.

In a further advantageous embodiment the outlet area is preferably arranged perpendicular to the longitudinal axis.

This is advantageous as thus the ions emerging from the outlet portion, are bundled such that substantially, preferably all, ions introduced in the inlet portion emerge again from the outlet portion. Thus swirls, turbulence and collision effects of the ions with the inner wall region are reduced by the present invention.

In a further advantageous embodiment the outlet portion is formed as a hydrodynamic nozzle-like element. This is advantageous as at the outlet area of the outlet portion which preferably corresponds to the outlet end of the device according to the invention, the ambient pressure falls in the range of 0.1 to 200 mbar, preferably into the range of 5 to 20 mbar. Furthermore, there is the possibility of further expansion of the ion gas cloud due to space charge or expanding background gas causing a reduction in the yield of subsequent ion transmission. Therefore the hydrodynamic nozzle-like form of the outlet portion is advantageous for setting the orientation direction of the emerging ions in the ion cloud bundling these as preparation for further processes. According to the invention, the shape of the inner wall region of the outlet portion is hydrodynamically optimized by applying mathematical simulations in order to reduce flow resistance and flow forces acting on the ion gas cloud and to increase the amount of transferred ions through the outlet portion. By this optimization of the inner wall shape, preferable concavely and/or convexly curved, edge effects and turbulences are reduced resulting in an increase yield of transferred ions.

Moreover, the shape of the outlet portion a hydrodynamic nozzle-like element is preferred to control the ion gas flow and thus the ion transmittance through the tube-like device according to the invention. Because of the special shape of the second inner wall region, a substantially parallel ion gas flow. Preferably ions emerge from the outlet area arranged substantially parallel to each other. Evidently the device according to the invention is not restricted to this but can for example be improved by suitable ion focussing optics known from the prior art. Such ion optics serve for additional bundling or focusing of the ions in relation to an analyser or ion separator.

In a further advantageous embodiment the inlet portion is formed as a hydrodynamic funnel-like element. This is advantageous as ions generated by the ion generation source expand due to space charge effects cloud-like. Therefore, it is advantageous for the inlet volume of the inlet portion to be shaped hydrodynamically, preferably rotationally symmetrical in relation to the longitudinal axis, giving a concentrically tapering cross section towards, the cylindrical middle portion for example. This is advantageous as this hydrodynamically optimized shape of the inner wall region of the inlet portion provides a reduction of flow resistance and flow forces acting on the ion gas cloud and thus, providing a bundling of the ion gas cloud and an increase in the amount of transferred ions through the inlet portion. By this optimization of the inner wall shape, preferable convexly and/or concavely curved, edge effects and turbulences are reduced resulting in an increase yield of transferred ions. This shape supports and maximises the flow rate of the ion gas cloud through the device according to the invention. The hydrodynamic shape of the inlet portion guides a high ion transmittance yield into the tube-like device according to the invention which is preferably formed as a capillary, and at the same time prevents turbulence during guidance of the ions through the inlet portion. According to the invention, the basic funnel-like shape is adapted according to the ion size and mass according to hydrodynamic simulations and ion flight path simulations. So, the inner wall shape of the hydrodynamic funnel-like inlet portion is concave in order to guide the ions on the ion flight paths almost lossless through the inlet portion towards the middle portion and/or outlet portion Moreover, the shape of the hydrodynamic funnel-like element may also be concave and/or convex as well. Thus, this element may have a concave curvature followed by a convex curvature or vice versa.

In a further advantageous embodiment the device according to the invention is formed as one piece. This is advantageous as thus no protrusions or edges are created between the inlet portion and cylindrical middle portion and between the cylindrical middle portion and the outlet portion. These protrusions/edges have a negative effect on the ion flight paths and cause additional turbulence and deflection of the ions, reducing the ion yield. A corresponding one-piece tube-like device according to the invention thus allows the even guidance and focussing of individual ions, reducing collision losses with wall regions. According the invention, the inner surface of the whole device, representing the area which is oriented towards the ions, is polished and smooth. Preferably the inner surface has a surface roughness $R_a$ in the range of 1 nm to 1 μm, preferably from 1 to 100 nm.

Furthermore it is also conceivable that the inlet portion and/or outlet portion can be pressed or screwed onto a cylindrical middle portion as attachment elements, for example. This is advantageous as thus the device can also be fitted to standard capillaries. To avoid corresponding edges, press-on or screw-on inlet portions and/or outlet portions are welded and/or soldered to the cylindrical middle portion. Preferably these two portions are shaped by electro erosion process.

In a further advantageous embodiment at least one heating element for adjusting a pre-determinable temperature of the ion gas cloud is provided. By applying an increased temperature to the ions transferred through the device according to the invention, the evaporation of carrier molecules is aided, increasing the ion yield and the stability of the ion source. In the simplest embodiment example the device according to the invention can be tempered as a whole, wherein preferred temperatures are in the range of 50 to 300° C., most preferred in the range of 100 to 200° C. are adjusted. The device is therefore arranged within a corresponding recess of a heating element, which is made from heat conductive materials, such as metals, alloys or polymers. In longitudinal direction, the device is surrounded at least partially, preferred completely, by the heating element. For adjusting the temperature of the heating element at least one temperature sensor is provided. Another embodiment shows an indirect heating (cooling) by applying heated (cooled) gas around the device according to the invention.

For temperature adjustment of the ion gas cloud passing through the device according to the invention, it is advantageously that at least one and preferably two to ten temperature detection sensors which are preferably arranged in the inner wall region of the channel-like orifice along the longitudinal axis are provided. This is advantageous as thus the temperature in the interior of the channel-like orifice can be detected and recorded. Preferred temperatures of the cylindrical middle portion are in the range of 100 to 300° C., most preferred in the range of 140 to 200° C.

Furthermore it is conceivable that the different sections of the device according to the invention i.e. at least the inlet portion, middle portion and outlet portion can be tempered differently. Advantageously the individual sections are separated from each other by thermal insulation elements, wherein the inner wall of the device according to the invention remains continuously smooth without protrusions or grooves in order thus to prevent swirls and collision effects. Preferably the inlet portion is tempered in the range of 50 to 250° C. and the end portion is tempered in the range of 30 to 100° C. According to the invention, a temperature gradient is applied to the tube-like device, wherein the temperature is highest at the inlet portion and decreases towards the outlet portion.

In a further advantageous embodiment, preferably by using a pneumatic ion generating source, a curtain gas flow focusing the ion cloud after emerging from the ion generation source has a temperature of 20 to 250° C., preferably between 90 and 190° C. This is advantageous insofar as the ion generation source is not arranged inside the funnel-like inlet portion. The additional curtain gas flow is used to bundle the ions emerging from the ion generation source. The increased temperature of this gas flow removes the volatile carrier material before entering into the device according to the invention. Preferred gases are nitrogen, carbon dioxide, argon, dry air or a mixture thereof. The surplus of curtain is split off in order to balance the gas flow and to allow high ion transmittance ratios through the device according to the invention.

Furthermore, it is conceivable that between the ion generation source and the funnel-like inlet portion of the device according to the invention an ion funnel is arranged which for example comprises a multiplicity of ring electrodes spaced apart from each other by isolation elements. Advantageously such ring electrodes each have a centrally arranged orifice with a decreasing orifice cross section in the direction of the inlet portion. In this area, the ion gas cloud velocity is rather low and the ion's trajectories can thus be influenced by external electric fields.

Furthermore the present invention comprises a chamber system for transmitting ions generated by means of ion generation source, comprising an ionisation source under atmospheric pressure to generate ions from a pre-determinable liquid or solid specimen material, a tube-like device for transferring the generated ions according to at least one of the features of claims 1 to 10, and a device for receiving the generated ions, wherein the ion generation source is preferably arranged within a funnel-like inlet portion. This is advantageous as thus the ions according to the invention can be transferred loss-free from atmospheric pressure into an environment under vacuum. As a device for receiving the emitted ions from the device according to the invention, different well-known ion optics devices may be understood, such as an ion funnel, a quadrupole or octopole mass analyzer, a mobility analyzer as well as substrate for collecting the ions.

In a further advantageous embodiment at least one ion is transferred in the longitudinal direction by ion optics. Advantageously the ion optics are at ambient pressure i.e. normal atmospheric pressure of around 1013 hPa and arranged between the ion source and the device according to the invention. In particular for pneumatically assisted ion generation sources, because of a higher number of ions generated, correspondingly a larger outlet volume of the ion gas cloud is created. The ion optics limit the expansion of the ion cloud due to space charge and bundle this in a targeted manner. For example ring electrodes to which a DC voltage can be applied can bundle the ions in the gas cloud and focus these on a reduced cross section so the ions generated can be introduced almost loss-free through the funnel-like inlet segment into the cylindrical middle portion of the device according to the invention. In a preferred manner, another embodiment of the invention suggests that the ion optics are at least partially arranged remotely from the inlet portion and focus the ions towards an orifice of the inlet portion.

In a further embodiment, the use of the tube-like device according to the invention is as part of mass spectrometers and/or an ion separators and/or in ion deposition processes and/or in ion detectors and/or in ion mobility spectrometers and/or in ion traps. The device according to the invention may be used everywhere in order to transfer particles as ions, biological or artificial molecules from a high pressure atmosphere to a low pressure atmosphere.

In addition it is conceivable that after the outlet portion of the device according to the invention and before the device for receiving the ions, at least one aperture is provided by means of which the cross section of the outlet area of the outlet segment can be enlarged or reduced in a pre-determinable fashion by applying various voltages to the aperture.

Also it is conceivable that a system according to the invention for ion detection or ion separation has more than one device according to the invention for transmitting ions. It is for example conceivable that several devices according to the invention with different inner diameter, length, inlet portion opening angle and/or outlet portion opening angle can be arranged and mounted detachably in a carousel-like device, wherein the carousel-like device is arranged rotatable about the longitudinal axis. This is advantageous as thus different specimen materials can be processed simply and quickly as there is no need for lengthy exchanges and subsequent readjustment. Advantageously this device is electronically controllable.

The tube-like device according the invention preferably are fabricated from metal, alloys, glass, ceramics, compound materials as fibre-reinforced polymer materials being high-temperature stable, wherein the material is inert and does not react physically or chemically with the transferred ions. In case of using glass or other insulators as substrate material, it is preferred to coat at least partially the inlet portion and the outlet portion with metals, for example by sputtering. Moreover, the whole device may be coated with electro conductive materials by metallization or galvanization, for example. By coating the inlet portion, the middle portion and the outlet portion with different electro conductive materials, different voltage may be applied to each portion in order to influence the ion transfer through the whole device.

The tube-like device according the invention is not limited to the transfer of ions. It is also possible to transfer particles like neutral molecules, atoms or even nanoparticles from a high pressure atmosphere to a low pressure atmosphere. Herewith, these particles are ejected by known nozzles, for example at atmospheric pressure, and guided into the inlet portion of the tube-like device according the invention transferring these particles to a low pressure atmosphere, for example a vacuum.

Furthermore, it is conceivable that the middle portion is not restricted to a regular cylindrical shape. In further embodiments, the middle portion may have alternative cross-sections like ellipsoidal, squared or polygonal in general. Moreover, the cross-section of the middle portion, which is perpendicular arranged with respect to the longitudinal axis, may vary in longitudinal direction of the device according to the invention. This is advantageous for the ion transfer through the device in order to reduce ion losses.

Moreover, in a simple embodiment, the middle portion is linear. However, in dependence of the ions it is also conceivable that the middle portion is provided in a curved manner providing at least one change in direction with respect to the longitudinal direction. This curvature may be concave and/or convex. In dependence of the radius of the curvature, a preselection of the ions transferred through the middle portion is provided because ions with a low molecular mass follow the curvature whereas ions with higher molecular masses collide with inner wall regions. Optionally, additional ion optics are used for an improved guidance of the ions in a curved middle portion in order to reduce ion losses.

In addition, apparatuses for measuring, monitoring, controlling, sensoring or switching of the ions transferred through the middle portion or a combination thereof may be provided within the middle portion and/or as additional part of the middle portion and/or instead of the middle portion.

Moreover, it is conceivable that an embodiment of the present invention comprises a middle portion and a funnel-like outlet portion, which may additionally be curved concavely and/or convexly. In this embodiment, an inlet portion is replaced by conventional ion optics, for example. However, the present invention is not limited to these embodiments. In dependence of the application, it is also conceivable that no middle portion is provided, but only the inlet and outlet portion, both preferably hydrodynamically optimized according to the invention, are fixed to each other. This is advantageous, as ions or particles in general needed to be transferred directly from a first area to a second area, wherein, for example, the areas differ in temperature, gas environment or pressure. In addition, also the inlet portion as well as the outlet portion, both preferable hydrodynamically optimized according to the invention, may be used as single parts for ion or particle transfer.

Furthermore, in dependence of the application, the present device may also provide only an inlet portion and/or and outlet portion with a very short or no middle portion.

Moreover, the cylindrical middle portion 102 has an inner diameter of 0.25 to 5 mm, preferably 0.5 to 1 mm, and, in the longitudinal direction I, has a length of 0 to 250 mm, preferably 60 to 100 mm. In addition, the outlet portion has an inner diameter in the range of 2 mm to 25 mm, preferably 3 mm to 13 mm and most preferred 6 mm to 10 mm.

BRIEF DESCRIPTION OF THE DRAWINGS

Further advantageous embodiments arise from the enclosed drawings.

These show.

DETAILED DESCRIPTION OF THE INVENTION

Figure 1:
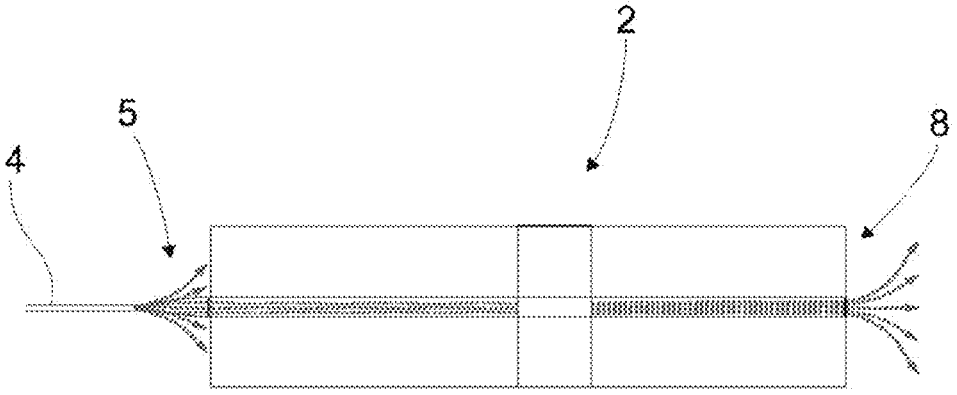
FIG. 1 a capillary known from the prior art.

FIG. 1 shows a schematic depiction of a capillary 2 known from the prior art. An ion generation source 4 emits a gaseous ion beam 5 resulting from a specimen material, wherein the beam, after emergence from the ion generation source 4, because of space charge effect, expands cloud-like between the ion generation source 4 and known capillary 2 in a region A so that only a small percentage of emitted ions can be guided through a central channel 6 of the capillary 2. In longitudinal direction I at the end region 8 of the capillary known from the prior art, because of the edges 10*a* and 10*b* turbulence effects occur so that the flight paths 12 of the individual ions emerge expanding out of the outlet 14. As ion flight paths 12, ion trajectories may be understood on which the ions are transferred through the capillary 2.

The subsequent detector 16 only receives a small number of generated ions over a large area, wherein such a detector may be a mass spectrometer detector, an ion separator or a substrate for ion deposition, as well. In such capillaries from the prior art, due to their geometry, ion loss ratios between 90 and 99% are typical. Therefore relatively high concentrations of specimen material are required to be able to perform corresponding mass spectrometric analyses. Also high sensitivity detectors are required which usually have a high cost price.

Figure 2:
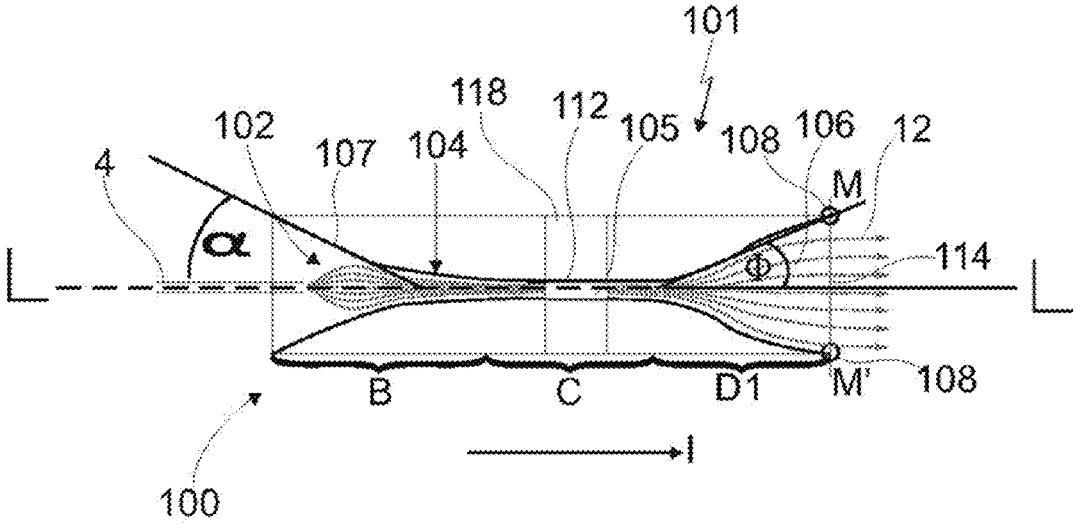
FIG. 2 a cross section of a tube-like device according to the invention.

FIG. 2 shows a cross section through a tube-like device 100 according to the invention with an inlet portion 102, a cylindrical middle portion 104 and an outlet portion 106. In the simplest embodiment (not shown) the inlet portion 102 is formed funnel-like so that its cross section, which is oriented perpendicular to the longitudinal axis L, diminishes towards the middle portion 104. This geometry is advantageous as thus the ions (not shown) generated by the ion generation source 4 and emitted as an ion gas are limited in their physical expansion, leading to a pre-determinable bundling of the ion flight paths 12 such that on entry of the ion flight paths 12 into the cylindrical middle portion 104, perturbations are reduced. The cylindrical middle portion 104 has a continuous orifice 105 extending along the longitudinal axis L and formed channel-like. As ion flight paths 12, ion trajectories may be understood on which the ions are transferred through the device 100.

For improved bundling and guidance of the emitted ions on the ion flight path 12, the inlet portion 102 is hydrodynamically optimized in order to reduce flow resistance and flow forces action on the ions. Thus, the inner wall area of the inlet portion is formed concavely curved with respect to the longitudinal axis L in region B. The concave curvature 107 of the inlet portion 102 is advantageous as thus the ions are bundled and guided pre-determinably into the cylindrical middle portion 104, preferably lossless. Turbulence is also reduced. The cylindrical middle portion 104 is formed tube-like so that opposing walls 110, 112 in the longitudinal direction I are arranged substantially, preferably fully, parallel to each other in region C.

The outlet portion 106 in the simplest case is formed funnel-like expanding in longitudinal direction I in region D (not shown). According to the invention the outlet portion 106 is hydrodynamically optimized in order to reduce flow resistance and flow forces action on the ions. Thus, the inner wall area of the outlet portion is formed with concave curvature in an inner first wall region D1. This is advantageous since, on use of the device 100 according to the invention as part of a mass spectrometer, the outlet portion 106 is under vacuum whereas the inlet portion 102 is exposed to atmospheric pressure. A pressure gradient therefore exists between the inlet portion 102 and the outlet portion 106. Due to the vacuum applied at the outlet portion 106, on emergence of the ions for example swirls and shockwaves are caused so that the ion gas cloud expands uncontrollably.

According to the invention this undesired and uncontrollable expansion of the emerging ion gas is physically limited by the first inner wall region D1. Due to the special concave curvature, on introduction of the ions into the outlet portion 106, the ion flight paths 12 are initially expanded and then oriented again substantially parallel to each other at the outlet area 114. The outlet area 114 corresponds to the end cross section of the outlet portion 106 along line MM' and is defined by a multiplicity of side edge closing points 108. Thus, the emitting ion flow out of the outlet area 114 is substantially in a laminar flow.

The outlet area 114 according to the invention has an inner diameter in the range from 1 to 30 mm, preferably in the range from 5 to 15 mm. Advantageously the inlet portion 102 has the same inner diameter but evidently is not limited to this. Depending on use, the inner diameter of the inlet portion 102 can be smaller than, equal to or greater than the inner diameter of the outlet area 114 of the outlet portion 106.

The cylindrical middle portion 102 has an inner diameter of 0.25 to 5 mm, preferably 0.5 to 1 mm, and in the longitudinal direction I has a length of 0 to 250 mm, preferably 60 to 100 mm.

As illustrated, the angle a indicates the opening of the inlet portion 102 in dependence of the longitudinal axis L, wherein the angle f indicates the opening of the outlet portion 106 in dependence longitudinal axis L.

Figure 3:
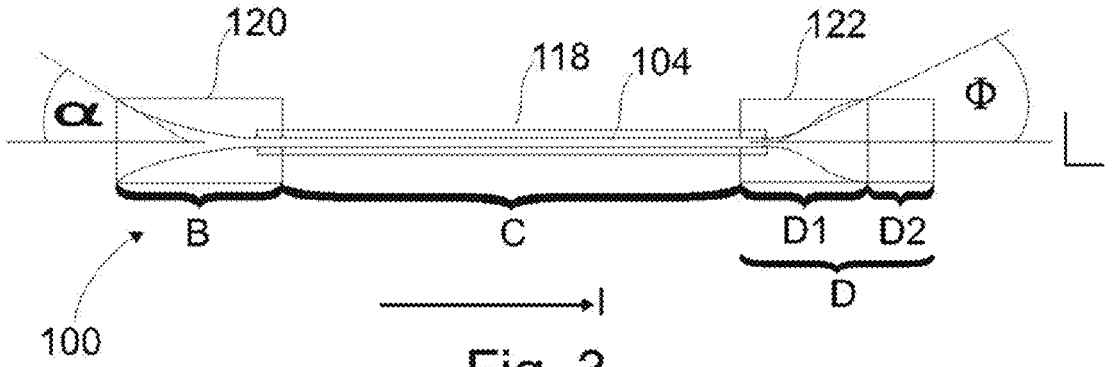
FIG. 3 a schematic cross section of a further device according to the invention.

FIG. 3 shows a further embodiment of the invention 100, wherein here, on the cylindrical middle portion 104 a press-fit funnel-like and/or internally concavely curved first attachment element 120 corresponding to the inlet portion 102 and a second funnel-like and/or internally concavely curved second attachment element 122 corresponding to the outlet portion 106 are arranged. By means of suitable preferably seamless fixing, the first and second attachments 120, 122 are for example soldered and/or welded to the cylindrical middle portion 104. Depending on the desired flow profile of the ions generated by the ion generation source, inlet portion 102 and outlet portion 106 are not restricted to be only concavely curved as described here. It is for example conceivable that the inner wall of the inlet portion 102 and/or the outlet portion 106 and/or the corresponding attachments 120, 122 is/are formed undulating in the longitudinal direction I in combination with the specific feature of a concavely curved design of the inlet portion and/or the outlet portion. In this embodiment, the device 100 is edge-free in order to reduce turbulences. For example depending on pressure and/or gas species, the shape of the device 100 may be further improved.

It is advantageously conceivable that directly after the first inner wall region D1 is a second inner wall region D2 which, like the cylindrical middle portion 104, is formed tube-like with its walls arranged parallel to each other along the longitudinal direction I. The arrangement of the second inner wall region D2 is advantageous in order to stabilise the mutually parallel orientation of the ion flight paths 12 in the longitudinal direction I within the outlet portion 106 and create a laminar ion flow. The substantially, preferably completely mutually parallel orientation of the ion flight paths in the second inner wall region D2 prevents turbulence. The concave expansion of the outlet portion 106 in the first inner wall region D1 also causes an acceleration of the ions guided through the cylindrical middle portion 104, whereby more efficient separation is possible when the device 100 according to the invention is used according to the invention in an ion separator.

As illustrated, the angle a indicates the opening of the first attachment element 120 as inlet, wherein the angle f indicates the opening of the second attachment 122 as outlet.

Figure 4:
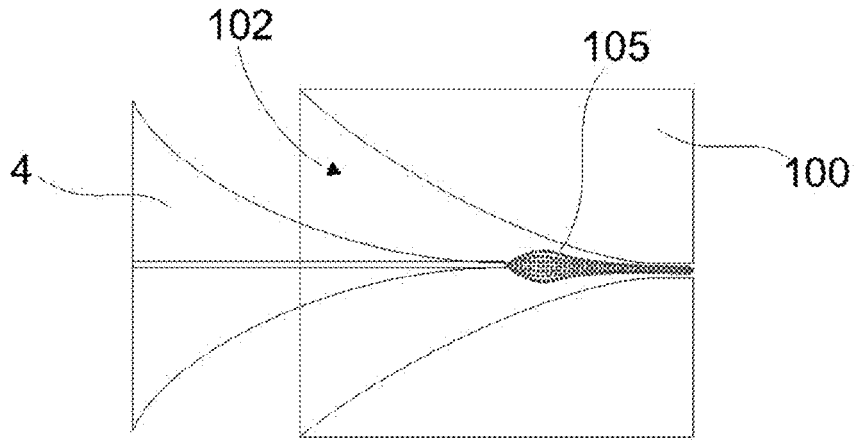
FIG. 4 a schematic cross section of a further device according to the invention, FIG. 5 a schematic cross section of a further device according to the invention, FIG. 6*a*, 6*b* two schematic diagrams of ion transmittance in vacuum with and without hydrodynamic funnel, and FIG. 7 two schematic diagrams indicating the transmittance effectiveness.

FIG. 4 shows a further embodiment of a hydrodynamically optimized inlet portion 102 according to the present invention 100. The inlet portion 102 is shaped concavely tapering towards the cylindrical middle portion 104. In this embodiment, a nanospray ionisation source 4 is arranged within the inlet portion 102. The space charge expansion of the ion gas cloud 5 is limited both by the concave shape of the inlet portion 102 and by the corresponding concave shape of the ion source 5. By providing a different geometry of the ion source 5, preferably with a comparable curvature as the inlet portion 102, the velocity of the ion gas cloud 5 increases significantly. Due to this increased ion velocity, space charge effects are reduced within the ion gas flow through the device 100 resulting in higher transmittance.

Figure 5:
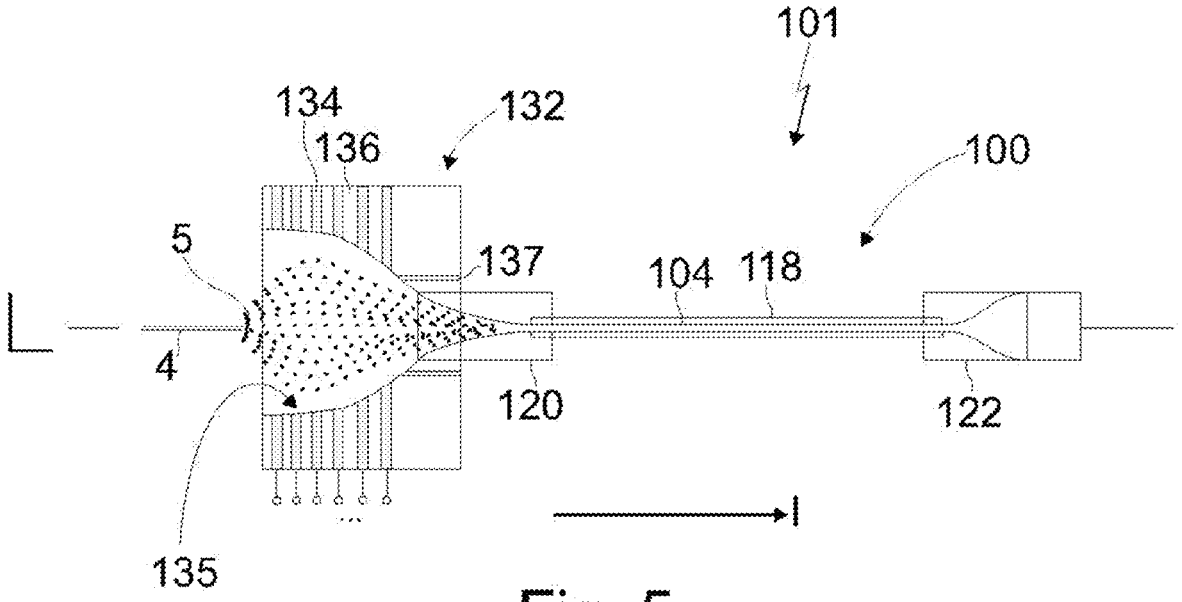

FIG. 5 shows a device 100 according to the invention, wherein the ion generation source 4 is arranged in longitudinal direction I in front of the device 100 according to the invention. The ion generation source 4 is formed for example as a pneumatic ion generation source. Around the pneumatic ion generation source 4 on the periphery is provided a gas supply (not shown) releasing a curtain gas (not shown) for guiding and atomising further the aerosol emerging from the ion generation source 4. This gas supply 130 provides at least one further high speed gas flow. Therefore, according to the invention, in region A' between the ion generation source 4 and the inlet portion 102 at least one ion optic 132 is arranged which is exposed to ambient pressure i.e. atmospheric pressure.

A corresponding ambient pressure ion optic 132 is composed of a multiplicity of ring electrodes 134 each mutually spaced by at least one isolating element 136. Advantageously ring electrodes 134 and isolation elements 136 are fixedly arranged on each other such that a smooth, continuous surface 135 results having no sharp edges or protrusions. Thus, both ring electrodes 134 and isolating elements 136 are not directly exposed to the ion gas cloud 5 but are shielded. This is advantageous as the ions are guided to the inlet portion 102. A surplus of curtain gas is split off by splitting channels 137. The isolation elements 136 are for example made of plastic or ceramic. The ring electrodes 134 each have a central orifice, the cross section of which diminishes in the longitudinal direction I towards the device according to the invention. Advantageously the ambient pressure ion optic 132 is formed funnel-like and serves as a pre-stage for bundling the ions.

On application of a DC voltage to these ring electrodes 134, the ions emerging from the ion generation source 4 are pre-bundled and compressed in their physical expansion. To support this process, inert gas 138 can also be used which is preferably pre-tempered in the range from 20 to 250° C. It is obvious that instead of the shown attachments 120, 122 also a device 100 according FIG. 2 is suitable to use.

EXAMPLE

In first experiments the transmission of an API with a funnel-like inlet portion was compared with its conventional counterpart. An ion source 4 with a device 2, 100 was constructed, wherein the device could be exchanged without altering the geometry, realizing comparable measurements.

Experiments with capillary 2 and device 100 were carried out using a nanoelectrospray ion source made of a pulled silica capillary emitter of 25 μm inner diameter, producing net currents of 20-40 nA from a 10-mmol/mL rhodamine 6G solution flowing at 20 μL/h.

A device 2 with a diameter of 1 mm, a short length of 70 mm was pre-heated to 180° C. In the vacuum chamber, pumped with a rotary pump with 16 $m^3$/h, a pressure of 20 mbar was adjusted. In this chamber the transmitted current $I_{trans}$ was measured on a target 140 mounted 2 cm downstream of the device 2. The loss current $I_{cap}$ was detected on the capillary 2. The total current emitted from the ion source $I_{tot}$ is equal to $I_{trans}+I_{cap}$.

Figure 6A:
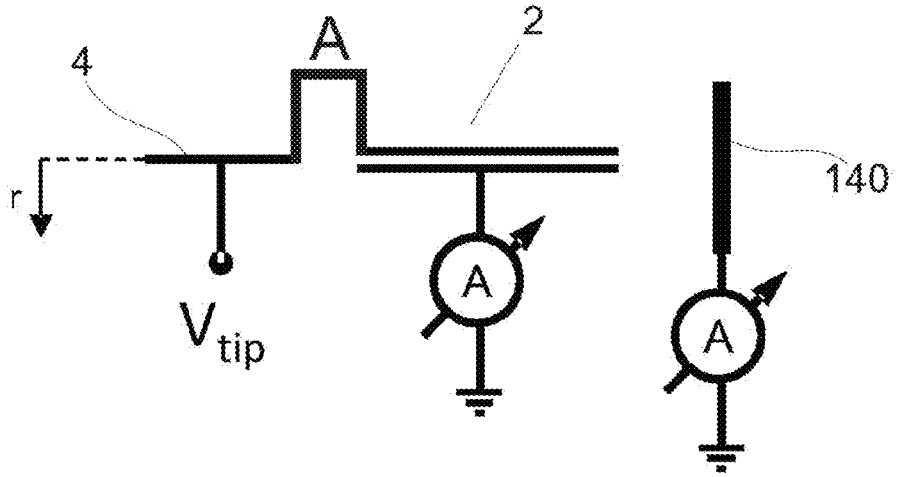
Figure 6A:
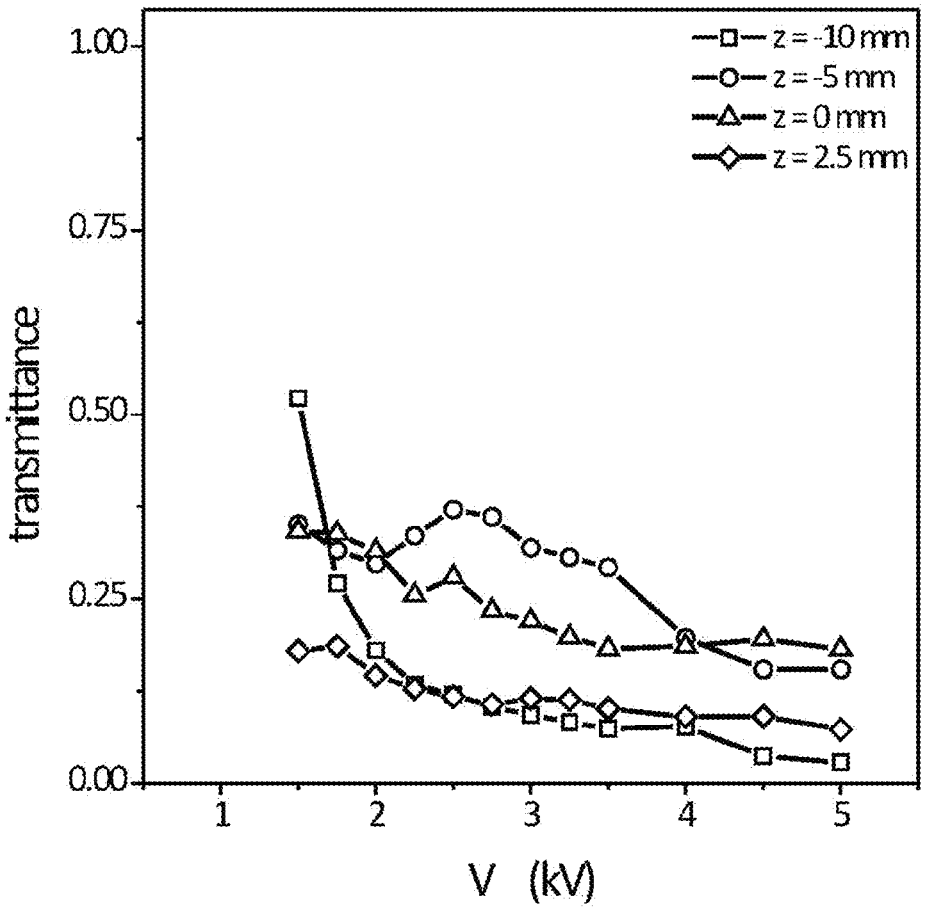

FIG. 6*a* shows on the ordinate the transmittance, defined as $I_{trans}/I_{tot}$, of the conventional interface for several device-to-ion source emitter distances in dependence of the voltage V at the ion source 4. Experimentally, the distances A between the ion source 4 and the capillary 2 were adjusted to 10 mm, 5 mm, 0 mm and −2.5 mm, wherein a negative distance A indicates the adjustment of the ion source 4 within the capillary 2. Due to the large diameter of the conventional device 2, transmission in the range of 10-30% was found.

A device 100 with a middle portion 104 with a diameter of 1 mm, a short length of 70 mm was pre-heated to 180° C. In the vacuum chamber, pumped with a rotary pump with 16 $m^3$/h, a pressure of 20 mbar was adjusted. Parameters were chosen as for the conventional capillary 2. In this chamber the transmitted current $I_{trans}$ was measured on a target 140 mounted 2 cm downstream of the device 100 in the area B. The loss current $I_{cap}$ was detected on the device 100. The total current emitted from the ion source $I_{tot}$ is equal to $I_{trans}+I_{cap}$.

Figure 6B:
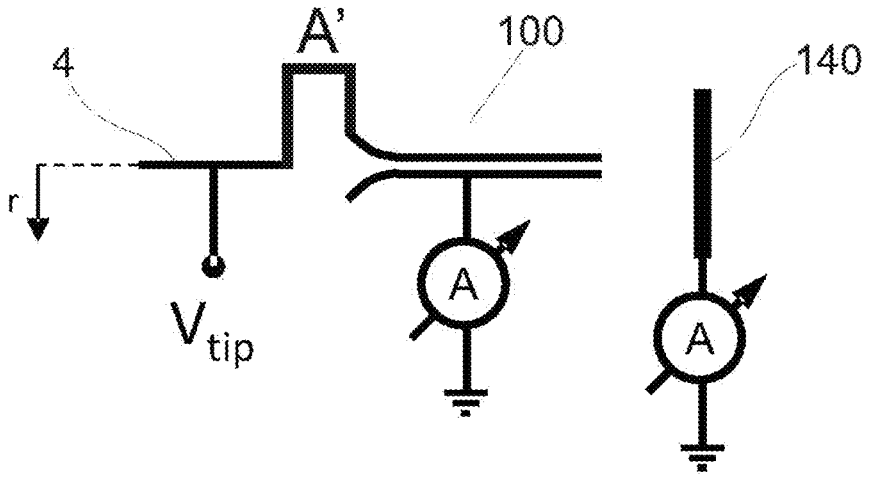
Figure 6B:
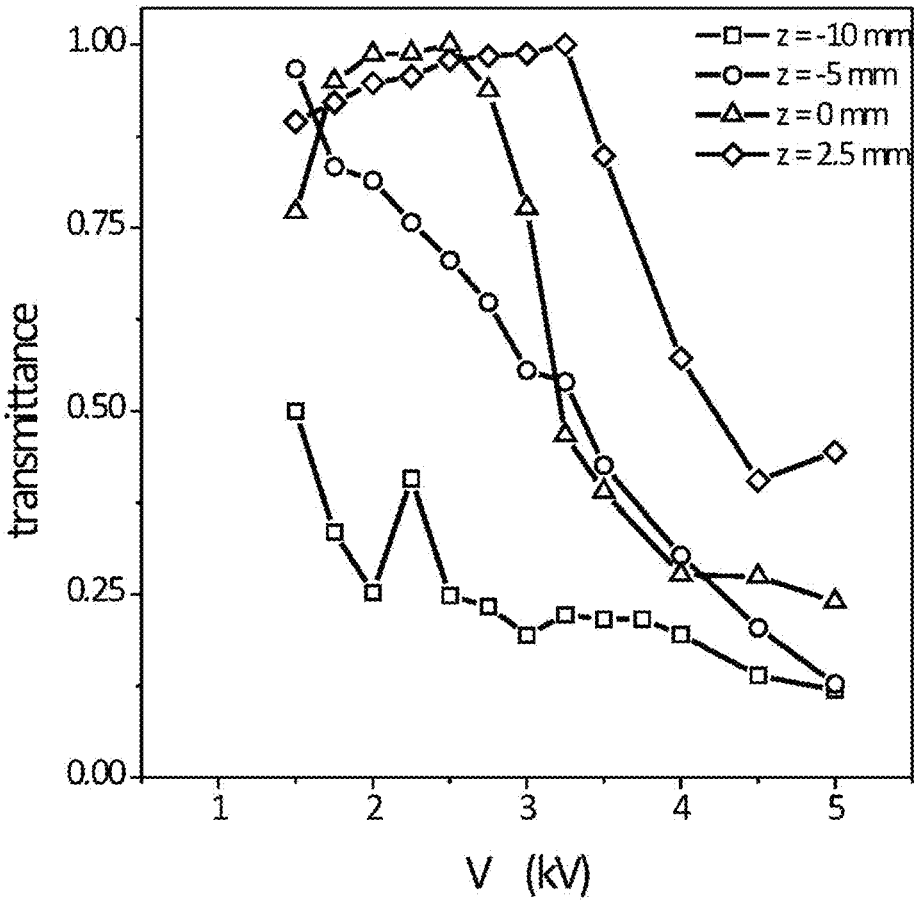

FIG. 6*b* shows on the ordinate the transmittance, defined as $I_{trans}/I_{tot}$, of the device 100 for several device-to-ion source emitter distances in dependence of the voltage V at the ion source 4. Experimentally, the distances A' between the ion source 4 and the device 100 were adjusted to 10 mm, 5 mm, 0 mm and −2.5 mm, wherein a negative distance A' indicates the adjustment of the ion source 4 within the inlet portion 102. Transmissions up to 100% were detected, in particular if the ion source 4 was placed close to or within the funnel-like inlet portion 102.

Thus, for an ion source 4 such as a nanospray ion source emitter funnelling, according the invention is sufficient to achieve a uniform transmittance up to 100% of all ions. Ambient pressure optics may be additionally needed to focus pneumatic sprays in order to achieve comparable results. The results of this experimental section proved that a factor of 10 to 100 in intensity can be gained without drawbacks.

Figure 7:
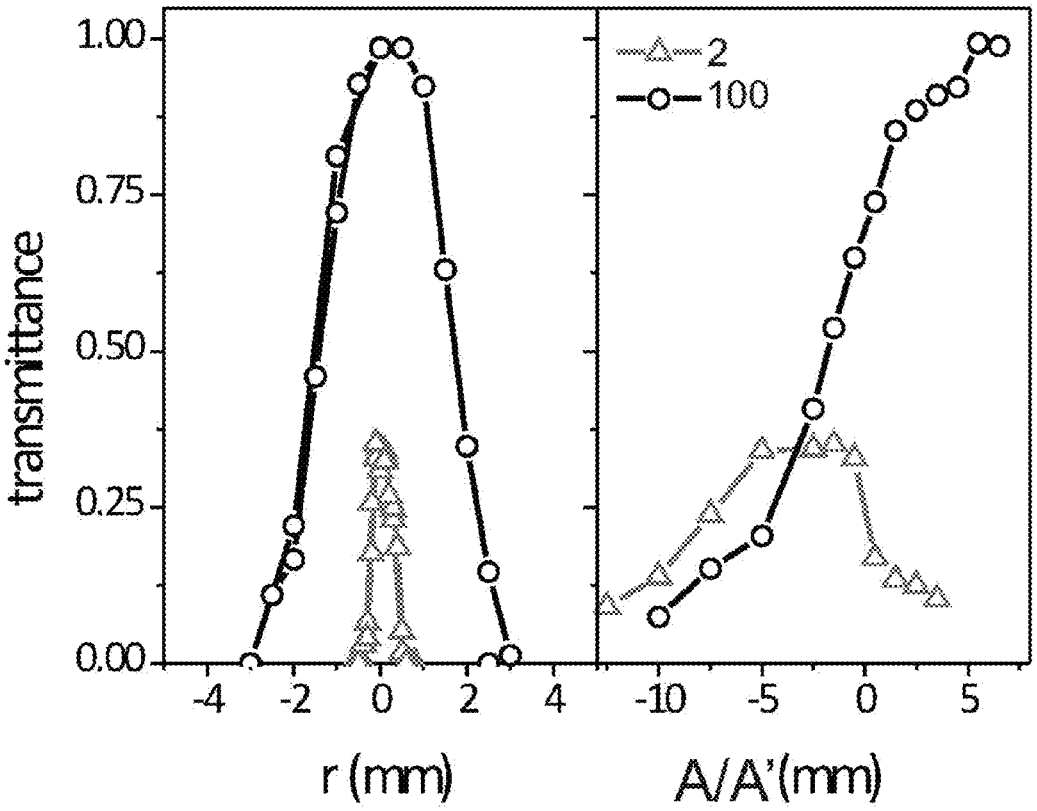

FIG. 7 shows the different ion transmittances depending on the ion source position of a capillary 2 known from the prior art and the device 100 according to the invention. On the left hand side, the transmittance, shown on the ordinate, of the generated ions through the capillary 2 and the device 100 is shown in dependence of the radial position r (abscissa) of the ion source 4. This diagram shows clearly that by using standard capillaries 2, slight changes in the radial position r of the ion source 4 reduce the transmittance significantly. Thus, ion source 4 and capillary 2 needed to be arranged very precisely. In contrast, by using the device 100 according to the invention radial position changes r of the ion source 4 up to +/−2 mm are acceptable resulting in further high transmittance.

The diagram on the right hand side shows on the ordinate the transmittance and on the abscissa the distance A and A', respectively. The advantage of the device 100 is that transmittance increases steadily by reducing the distance A' between ion source 4 and device 100. In contrast, capillaries 2 known from prior art, show very low transmittance at all distances A.

The applicant reserves the right to claim all features disclosed in the application documents as essential to the invention where novel individually or in combination in relation to the prior art.

REFERENCES

[1]J. S. Page, I. Marginean, E. S. Baker, R. T. Kelly, K. Tang and R. D. Smith, J. Am. Soc. Mass Spectrom. 20, 2265, 2009

LIST OF REFERENCE NUMERALS

2 Capillary
4 Ion generation source
5 Ion gas cloud
6 Channel
8 End area
10*a*, 10*b* Edges
12 Ion flight paths
16 Detector
100 Tube-like device
101 chamber system
102 Inlet portion
104 Cylindrical middle portion
105 Channel-like orifice
106 Outlet portion
108 Side edge closing points
110, 112 Walls
114 Outlet area
118 heating element
120 First attachment element
122 Second attachment element
130 Gas supply
132 Ion lens
134 Ring electrode
135 Surface
136 Isolation element
137 splitting channel
140 Target
L Longitudinal axis
I Longitudinal direction
A Distance ion source to prior art capillary
A' Distance ion source to device
B Inlet portion region
C Middle portion region
D Outlet portion region
D1 First inner wall region
D2 Second inner wall region
r radial position
α angle inlet portion
ϕ angle outlet portion

The invention claimed is:

1. A chamber system for transmitting ions generated by means of ion generation source, comprising:

a) an ion generation source under atmospheric pressure to generate ions from a pre-determinable liquid or solid specimen material;

b) a tube-like device for transferring ions generated by means of said ion generation source comprising a cylindrical middle portion and an inlet portion for introduction of the ions into the cylindrical middle portion, wherein a flow direction of the ions is along a longitudinal axis of the tube-like device, wherein the inlet portion is formed as a funnel tapering towards the cylindrical middle portion;

c) a heating element for heating the ions; and d) a device for receiving the emitted ions, wherein the ion generation source is arranged within said inlet portion wherein at least one ion is transferred in longitudinal direction by ion optics, characterized in that the ion optics are arranged at least partly remotely from the inlet portion and focus the ions towards an orifice of the inlet portion.

2. The chamber system according to claim 1, characterized in that the tube-like device further comprising an outlet portion after the cylindrical middle portion for removing the ions, wherein the outlet portion is formed as a funnel expanding from the cylindrical middle portion.

3. The chamber system according to claim 1, characterized in that said outlet portion has an outlet area which is limited in the longitudinal direction by side closure edge points of the outlet portion.

4. The chamber system according to claim 2, characterized in that a first inner wall region of the outlet portion is formed curved concavely in the longitudinal direction between the cylindrical middle portion and outlet area.

5. The chamber system according to claim 2, characterized in that a second inner wall region of the outlet portion, which follows the first inner wall region and is limited by the outlet area, is formed cylindrical in the longitudinal direction.

6. The chamber system according to claim 4, characterized in that opposing inner walls of the second inner wall region are arranged parallel with respect to the longitudinal axis.

7. The chamber system according to claim 2, characterized in that the outlet area is arranged preferably perpendicular to the longitudinal axis.

8. The chamber system according to claim 1, characterized in that the tube-like device is arranged within a corresponding recess of the heating element.

9. The chamber system according to claim 1, characterized in that the tube-like device is surrounded in the longitudinal direction at least partially by the heating element.

10. The chamber system according to claim 1, characterized in that the chamber system is formed of one piece.

11. The chamber system according to claim 1, characterized in that at least one heating element for adjusting predeterminable temperatures of the ion gas cloud is provided.

12. The chamber system according to claim 1, characterized in that a curtain gas flow focusing the ion cloud after emerging from the ion generation source has a temperature of 20 to 250° C.

13. The chamber system according to claim 1, characterized in that at least one temperature sensor is provided for adjusting the temperature of the heating element.

14. The chamber system according to claim 1, characterized in that the tube-like device is tempered as a whole, wherein the temperatures are in the range of 50 to 300° C.

15. The chamber system according to claim 1, characterized in that the tube-like device is at least partially tempered to a temperature in the range of 100 to 200° C.

16. Use of the chamber system according to claim 1, characterized in that the chamber system is arranged to be part of a mass spectrometer and/or ion separator and/or ion deposition and/or ion detector and/or ion mobility spectrometer and/or ion trap.

17. The chamber system according to claim 1, characterized by two to ten temperature sensors for temperature adjustment of the ions passing through the tube-like device.

18. The chamber system according to claim 17, characterized in that the temperature sensors are arranged in the inner wall region of the tube-like device.

19. The chamber system according to claim 18, characterized in that the temperature sensors are arranged in the inner wall region of the cylindrical middle portion of the tube-like device.

20. The chamber system according to claim 1, characterized in that the at least one heating element is configured to apply different heating power to different sections of the tube-like device.

* * * * *